US010907885B2

(12) United States Patent
Jung et al.

(10) Patent No.: US 10,907,885 B2
(45) Date of Patent: Feb. 2, 2021

(54) REFRIGERATOR

(71) Applicant: Samsung Electronics Co., Ltd., Suwon-si (KR)

(72) Inventors: Moon Gyo Jung, Suwon-si (KR); Byeong Kook Kang, Gwangju (KR); Sang Chul Ryu, Gwangju (KR); Jong-Hoon Oh, Gwangju (KR); Kyung Won Na, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 232 days.

(21) Appl. No.: 15/857,439

(22) Filed: Dec. 28, 2017

(65) Prior Publication Data

US 2018/0187957 A1 Jul. 5, 2018

(30) Foreign Application Priority Data

Jan. 3, 2017 (KR) ..... 10-2017-0000951

(51) Int. Cl.
*F25D 23/06* (2006.01)
*F25D 11/02* (2006.01)

(52) U.S. Cl.
CPC ..... *F25D 23/062* (2013.01); *F25D 11/02* (2013.01); *F25D 23/067* (2013.01); *F25D 23/069* (2013.01); *F25D 2500/02* (2013.01)

(58) Field of Classification Search
CPC .... F25D 23/062; F25D 23/067; F25D 23/069; F25D 11/02; F25D 2500/02
USPC ..... 312/401, 406, 406.2
See application file for complete search history.

(56) References Cited

U.S. PATENT DOCUMENTS 3,347,609 A * 10/1967 Mann ..... F24C 15/08 312/263
3,588,214 A * 6/1971 Stimamiglio ..... F25D 23/064 312/406
3,933,562 A * 1/1976 Cruckshank ..... B29C 51/04 156/250
4,173,379 A * 11/1979 van der Heiden ... A47B 88/941 312/348.1
5,486,045 A * 1/1996 Dasher ..... A47B 57/06 248/300
5,647,181 A * 7/1997 Hunts ..... A63H 33/10 312/111
5,797,514 A * 8/1998 Twiggar ..... F25C 5/182 220/683
9,308,677 B2 * 4/2016 Lee ..... F25D 23/028
2002/0105997 A1 8/2002 Zhang
(Continued)

FOREIGN PATENT DOCUMENTS

DE 102011006238 A1 * 10/2012 ..... F25D 23/063
JP H03211383 A 9/1991
(Continued)

OTHER PUBLICATIONS

ISA/KR, "International Search Report," International Application No. PCT/KR2017/015429, dated Apr. 12, 2018, 4 pages.
(Continued)

*Primary Examiner* — James O Hansen

(57) ABSTRACT

Disclosed herein is a refrigerator including an inner case formed by a plurality of sheets being assembled. The refrigerator may include an inner case having various materials and shapes, and a sheet forming one side of the inner case may be replaceable.

17 Claims, 18 Drawing Sheets

(56) References Cited

U.S. PATENT DOCUMENTS

| | | | | |
|---|---|---|---|---|
| 2003/0071550 | A1 | 4/2003 | Wolanin et al. | |
| 2011/0274888 | A1* | 11/2011 | Tang | B82Y 30/00 428/189 |
| 2013/0257256 | A1 | 10/2013 | Allard et al. | |
| 2016/0282035 | A1* | 9/2016 | Sul | F25D 23/065 |

FOREIGN PATENT DOCUMENTS

| | | | | | |
|---|---|---|---|---|---|
| JP | H07218110 | A | | 8/1995 | |
| JP | 2009264692 | A | * | 11/2009 | |
| JP | 5460817 | B1 | | 4/2014 | |
| JP | 2014126218 | A | * | 7/2014 | |
| JP | 2015-200458 | A | | 11/2015 | |
| JP | 6275530 | B2 | * | 2/2018 | |
| KR | 10-2006-0068774 | A | | 6/2006 | |
| KR | 10-2007-0104506 | A | | 10/2007 | |
| KR | 10-0776271 | B1 | | 11/2007 | |
| KR | 10-2012-0039905 | A | | 4/2012 | |
| KR | 10-2016-0115445 | A | | 10/2016 | |
| WO | WO-9804876 | A1 | * | 2/1998 | F25D 23/063 |

OTHER PUBLICATIONS

European Patent Office, "Supplementary European Search Report," Application No. EP17889683.3, dated Nov. 5, 2019, 7 pages.

* cited by examiner

REFRIGERATOR

CROSS-REFERENCE TO RELATED APPLICATION AND CLAIM OF PRIORITY

This application is related to and claims priority to Korean Patent Application No. 10-2017-0000951, filed on Jan. 3, 2017, the contents of which are incorporated herein by reference.

TECHNICAL FIELD

Embodiments of the present disclosure relate to a refrigerator, and more particularly, to a refrigerator having an assembly type inner case.

BACKGROUND

A refrigerator is apparatus including a main body having a storage compartment and a cold air supply system configured to supply cold air to the storage compartment to keep food fresh. The storage compartment includes a refrigerator compartment in which a temperature of about 0° C. to 5° C. is maintained to keep food refrigerated and a freezer compartment in which a temperature of about 0° C. to −30° C. is maintained to keep food frozen.

The main body of the refrigerator is provided by an inner case and an outer case being coupled. The inner case forms the storage compartment, and the outer case forms an exterior of the refrigerator. An insulating material for insulating is interposed between the inner case and the outer case. The storage compartment of the refrigerator is formed such that a front surface of the storage compartment is open, and the open front surface is closed by doors to maintain a temperature of the storage compartment.

Generally, the inner case of the refrigerator is formed through a vacuum forming method in which a sheet formed of a resin material is heated, the extended sheet is put on a mold, air is suctioned from a side opposite a side onto which the extended sheet is put, the heated sheet covers the mold or is drawn into the mold due to a suction force generated when the air is suctioned, and thus the inner case is formed.

A material usable for the inner case formed through the vacuum forming method is limited to a resin material. Even when a method in which an inner case is formed through the vacuum forming method and a metal sheet is attached to an inside of the inner case is used, since it is necessary for the metal sheet to be attachable to the inside of the inner case, a material for the inner case is limited by a type, a thickness, a weight, and the like of a material bonded thereto.

SUMMARY

To address the above-discussed deficiencies, it is a primary object to provide a refrigerator including an inner case in which a material used to implement the inner case is not limited, and which is formed of various materials and has various shapes.

It is another aspect of the present disclosure to provide a refrigerator including an inner case configured to allow a sheet forming one side of the inner case to be replaced without an additional mold being manufactured when the inner case of the refrigerator formed of various materials is formed.

Additional aspects of the disclosure will be set forth in part in the description which follows and, in part, will be obvious from the description, or may be learned by practice of the disclosure.

In accordance with one aspect of the present disclosure, a refrigerator including an inner case configured to form a storage compartment, an outer case coupled to an outer side of the inner case and configured to form an exterior, and an insulating material interposed between the inner case and the outer case. The inner case includes an upper sheet, a lower sheet, a left sheet, a right sheet, a rear sheet, and a front cover. Each of the left sheet and the right sheet is provided to be replaceable with a sheet having a different thickness.

Each of the left sheet and the right sheet may include one sheet of a first sheet having a first thickness and a second sheet having a second thickness greater than the first thickness, and the first sheet may include an edge bent to correspond to the second thickness.

At least one among the upper sheet, the lower sheet, the rear sheet, and the front cover may include side sheet insertion grooves formed at left and right edges thereof to allow the left sheet and the right sheet to be inserted into the side sheet insertion grooves.

Among a first member and a second member, which are adjacent to each other, among the upper sheet, the lower sheet, the rear sheet, and the front cover, the first member may include a flange configured to extend toward the second member. The second member may include a flange insertion groove formed at an edge of the second member located at a side of the first member and configured to allow the flange of the first member to be inserted into the flange insertion groove.

The first member may include a hook configured to protrude from one surface of the flange, and formed to be spaced a predetermined distance form an end portion of the flange. The second member may include a slot formed in the flange insertion groove and configured to accommodate the hook.

Among a first member and a second member, which are adjacent to each other, among the upper sheet, the lower sheet, the rear sheet, and the front cover, the first member may include a protrusion formed at an end portion of a side sheet insertion groove of the first member located at a side of the second member and configured to extend toward the second member. The second member may include a protrusion insertion groove formed at an end portion of a side sheet insertion groove of the second member located at a side of the first member and configured to allow the protrusion of the first member to be inserted into the protrusion insertion groove.

The protrusion of the first member and the protrusion insertion groove of the second member may be coupled by a coupling member.

The left sheet and the right sheet may include escape portions formed at corners therein such that the coupling member does not pass through the left sheet and the right sheet.

The rear sheet may include a first rear sheet and a second rear sheet disposed vertically. The first rear sheet may include a flange formed at a edge of first rear sheet located at a side of the second rear sheet, and the second rear sheet may include a flange insertion groove formed at a edge of second rear sheet located at a side of the first rear sheet to allow the flange of the first rear sheet to be inserted into the flange insertion groove.

The first rear sheet may include an uneven portion formed at one surface of the flange to prevent leakage of the insulating material.

The rear sheet may include a support member attached to a rear surface of the rear sheet and configured to connect the first rear sheet and the second rear sheet.

The rear sheet may include a shelf installation member attached to a front surface of the rear sheet and fixed to the support member to allow a shelf to be installed in the storage compartment.

The rear sheet may include a resin material, the first sheet may include a metal material, and the second sheet may include a ceramic material.

The second sheet may include a body layer having a ceramic material, a coated layer formed on the body layer located at a side of the storage compartment, and a reinforcing layer formed on the body layer located at a side of the outer case.

The reinforcing layer may include at least one layer of a first reinforcing layer having a metal material and a second reinforcing layer having a fiber material.

In accordance with another aspect of the present disclosure, a refrigerator including an inner case configured to form a storage compartment, an outer case coupled to an outer side of the inner case and configured to form an exterior, and an insulating material interposed between the inner case and the outer case. The inner case includes an upper sheet, a lower sheet, a left sheet, a right sheet, a rear sheet, and a front cover. Each of the left sheet and the right sheet includes one sheet of a first sheet having a first thickness and a second sheet having a second thickness greater than the first thickness. At least one among the upper sheet, the lower sheet, the rear sheet, and the front cover includes a side sheet insertion groove having a width corresponding to the second thickness.

The refrigerator may further include storage container installation members configured to allow a storage container to be installed in the storage compartment, wherein installation member installation holes may be provided in the left sheet and the right sheet to allow the storage container installation member to be installed on the left sheet and the right sheet.

Each of the storage container installation members may include a first support supported by the first sheet and a second support supported by the second sheet, and the first support may be formed to protrude from the second support to a height corresponding to the second thickness.

At least two adjacent sheets among the upper sheet, the lower sheet, and the rear sheet may be integrally formed.

The at least two integrally formed adjacent sheets include the side sheet insertion groove.

Before undertaking the DETAILED DESCRIPTION below, it may be advantageous to set forth definitions of certain words and phrases used throughout this patent document: the terms "include" and "comprise," as well as derivatives thereof, mean inclusion without limitation, the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
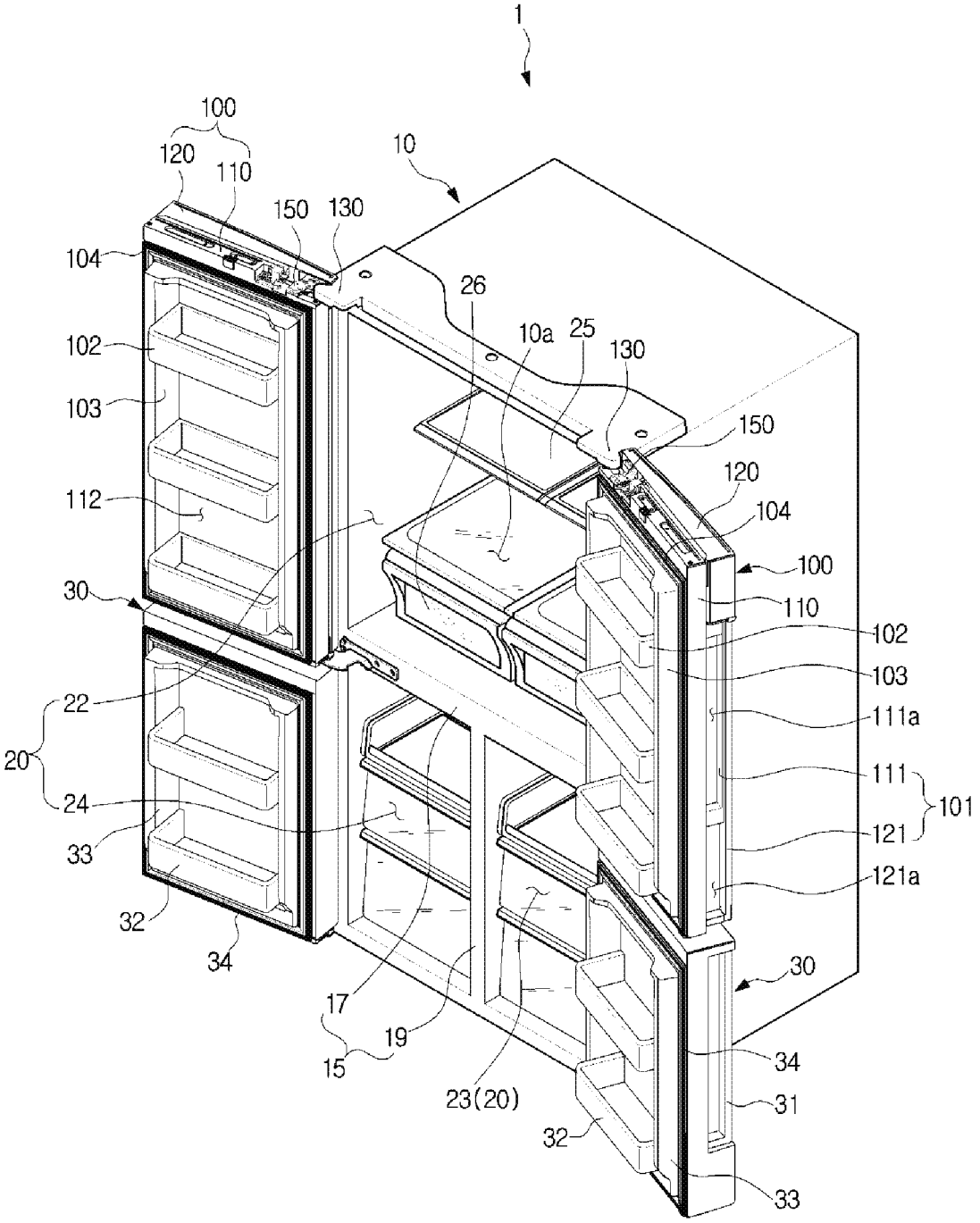
FIG. 1 is a view illustrating a front surface of a refrigerator according to one embodiment of the present disclosure and a state in which all first doors and second doors are opened.

FIGS. 1 through 18, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described in this specification and configurations illustrated in the accompanying drawings are only exemplary embodiments of the disclosed disclosure. The disclosure covers various modifications that may be substituted for the embodiments and drawings herein at a time of filing this application.

In addition, the same reference numerals or symbols in the drawings of this specification refer to parts or components that substantially perform the same function.

In addition, terms used in the present specification are merely used to describe the exemplary embodiments and are not intended to limit and/or restrict the embodiments. An expression used in the singular encompasses the expression of the plural unless the expression has a clearly different meaning in context. In the present specification, terms such as "including," "having," and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or be added.

In addition, it should be understood that, although the terms "first," "second," and the like may be used herein to describe various elements, the elements are not limited by these terms. The terms are only used to distinguish one element from another. For example, a first element could be termed a second element, and, similarly, a second element could be termed a first element without departing from the scope of the present disclosure. As used herein, the term "and/or" includes any and all combinations of one or more of the associated listed items.

Meanwhile, the terms such as "front end," "back end," "upper portion," "lower portion," "upper end," and "lower end" used in the specification are defined on the basis of the drawings, and shapes and positions of components are not limited by the terms.

Hereinafter, embodiments according to the present disclosure will be described in detail with reference to the accompanying drawings.

Figure 2:
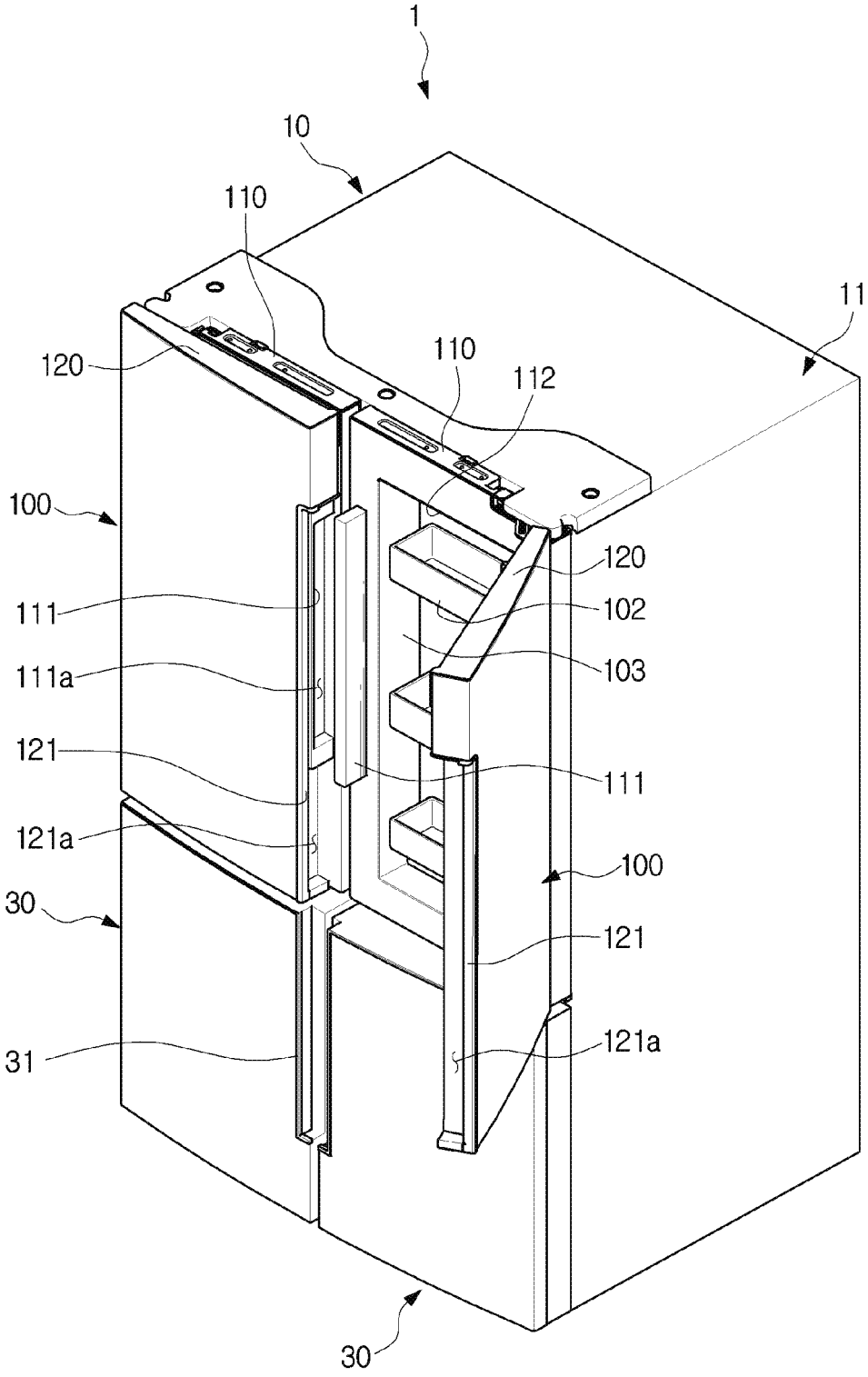
FIG. 2 is a view illustrating a state in which one second door of the second doors of the refrigerator of FIG. 1 is opened.

FIG. 1 is a view illustrating a front surface of a refrigerator according to one embodiment of the present disclosure and a state in which all first doors and second doors are open, and FIG. 2 is a view illustrating a state in which one second door of the second doors of the refrigerator of FIG. 1 is opened;

A refrigerator 1 includes a main body 10, storage compartments 20 divided into upper and lower sections in the main body 10, doors configured to open and close the storage compartments 20, and a cold air supply apparatus (not shown) configured to supply cold air to the storage compartments 20.

The main body 10 may include inner cases forming the storage compartments 20, an outer case 11 coupled to outer sides of the inner cases to form an exterior of the refrigerator 1, and an insulating material foamed in a space between the inner cases and the outer case 11 and insulate the storage compartment 20.

The cold air supply apparatus may generate cold air using a cooling cycle in which a refrigerant is compressed, condensed, expanded, and evaporated.

The plurality of storage compartments 20 may be divided by partitions 15, and a plurality of shelves 25 and a plurality of storage containers 26 may be provided in the storage compartments 20 to store food and the like.

The storage compartments 20 may be divided into a plurality of storage compartments 22, 23, and 24 by the partitions 15, and the partitions 15 include a first partition 17 horizontally coupled to an inside of the storage compartment 20 to divide the storage compartments 20 into an upper storage compartment 22 and lower storage compartments 23 and 24, and a second partition 19 vertically coupled in the lower storage compartments 23 and 24 to divide the lower storage compartments 23 and 24 into a first storage compartment 23 and a second storage compartment 24.

The partitions 15 having a "'T'" shape due to the first partition 17 and the second partition 19 being coupled may divide the storage compartments 20 into three spaces. Among the upper storage compartment 22 and the lower storage compartments 23 and 24, the upper storage compartment 22 divided by the first partition 17 may be used as a refrigerator compartment, and the lower storage compartments 23 and 24 may be used as freezer compartments.

Although the entirety of the lower storage compartments 23 and 24 may be used as the freezer compartment, the first storage compartment 23 may be used as a freezer compartment and the second storage compartment 24 may be used as a refrigerator compartment, or the first storage compartment 23 may be used as a freezer compartment and the second storage compartment 24 may be used as a freezer or refrigerator compartment.

The above described division of the storage compartments 20 is one example, and the storage compartments 22, 23, and 24 may be used differently from the above-described configuration.

The refrigerator compartment 22 may be opened and closed by a pair of door units 100 rotatably coupled to the main body 10. The pair of door units 100 may be opened and closed by a pair of refrigerator compartment door unit handles 101 including first door handles 111 and second door handles 121.

The freezer compartment 24 may be opened and closed by a pair of freezer compartment door units 30 rotatably coupled to the main body 10. The pair of freezer compartment door units 30 may be opened and closed by a pair of freezer compartment door unit handles 31. A sliding door may also be applied as a door configured to open and close the freezer compartment 24.

The pair of door units 100 and the pair of freezer compartment door units 30 may open and close a main body opening 10*a* of the open main body 10. Door shelves 102 and 32 capable of accommodating food may be provided on rear surfaces of the pair of door units 100 and the pair of freezer compartment door units 30.

The door shelves 102 and 32 may include shelf supports 103 and 33 formed at both right and left sides of the door shelves 102 and 32 and configured to vertically extend from the door units 100 and 30 to support the door shelves 102 and 32. The shelf supports 103 and 33 may be additionally provided to be detachable from the door units 100 and 30, and in the embodiment, the shelf supports 103 and 33 are provided to extend from the door units 100 and 30.

In addition, first gaskets 104 and 34 may be provided at edges of the rear surfaces of the door units 100 and 30 to seal gaps between the door units 100 and 30 and the main body 10 in a state in which the door units 100 and 30 are closed. The first gaskets 104 and 34 may be installed in a loop shape along the edges of the rear surfaces of the door units 100 and 30 and include magnets (not shown).

The pair of door units 100 configured to open and close the refrigerator compartment 22 may be disposed at a right side and a left side of the refrigerator compartment 22. Hereinafter, the door unit 100 disposed at the left side will be described for the sake of convenience in the description, and the door unit 100 disposed at the left side will be referred to as the door unit 100. However, the door unit 100 which will be described below is not limited to the door unit 100 disposed at the left side, may be applied to the door unit 100 disposed at the right side, and may also be applied to at least one of the pair of freezer compartment door units 30.

The door unit 100 may include a double door having a first door 110 and a second door 120.

The first door 110 may be rotatably connected to the main body 10 by a first hinge unit 130 and configured to open and close the main body opening 10*a* of the main body 10. The door shelves 102, the shelf supports 103, and the first gasket 104 described above may be provided at the first door 110.

The first door 110 may include a first door handle 111 formed to be gripped by a user when the user opens and closes the first door 110. The first door handle 111 may be provided at one end portion of the first door 110 opposite the other end portion of the first door 110 connected to the first hinge unit 130. The first door handle 111 is formed to be inserted into a second handle space 121*a* formed by the second door handle 121. The first door handle 111 may form a first handle space 111*a*, and the user may grip the first door handle 111 via the first handle space 111*a* and open and close the first door 110. When the door unit 100 is opened using the first door handle 111, the first door 110 is opened and the second door 120, which will be described below, is also opened.

The first door 110 includes a first door opening 112 formed to allow the user to approach the door shelf 102 and put food in or take food out of the refrigerator when the first door 110 is closed. Such a first door opening 112 may be formed to pass through the first door 110 and be opened and closed by the second door 120.

The second door 120 may be provided in front of the first door 110 to open and close the first door opening 112 of the first door 110, and may be provided to rotate in the same direction in which the first door 110 rotates. In the embodiment of FIG. 1, the second door 120 is illustrated to be rotatably supported by a second hinge unit 150 installed at the first door 110 and be rotatable about the first door 110, but is not limited thereto, and the second hinge unit 150 may also be installed at the main body 10 such that the second door 120 may be provided to be rotatable about the main body 10.

The second door 120 may include the second door handle 121 formed to be gripped by the user when the user opens and closes the second door 120. The second door handle 121 may be provided at one end portion of the second door 120 opposite the other end portion of the second door 120 connected to the second hinge unit 150. The second door handle 121 may be formed to be larger than the first door handle 111 to allow the first door handle 111 to be inserted into the second door handle 121. The second door handle 121 may form a second handle space 121*a*, and the user may grip the second door handle 121 via the second handle space 121*a* and open and close the second door 120. When the door unit 100 is opened using the second door handle 121, the first door 110 may not be opened and only the second door 120 may be opened.

The second door 120 may include a second gasket (not shown) for maintaining a seal between the second door 120 and the first door 110. The second gasket (not shown) may be installed in a loop shape along an edge of the rear surface of the second door 120 and include magnet (not shown).

Figure 3:
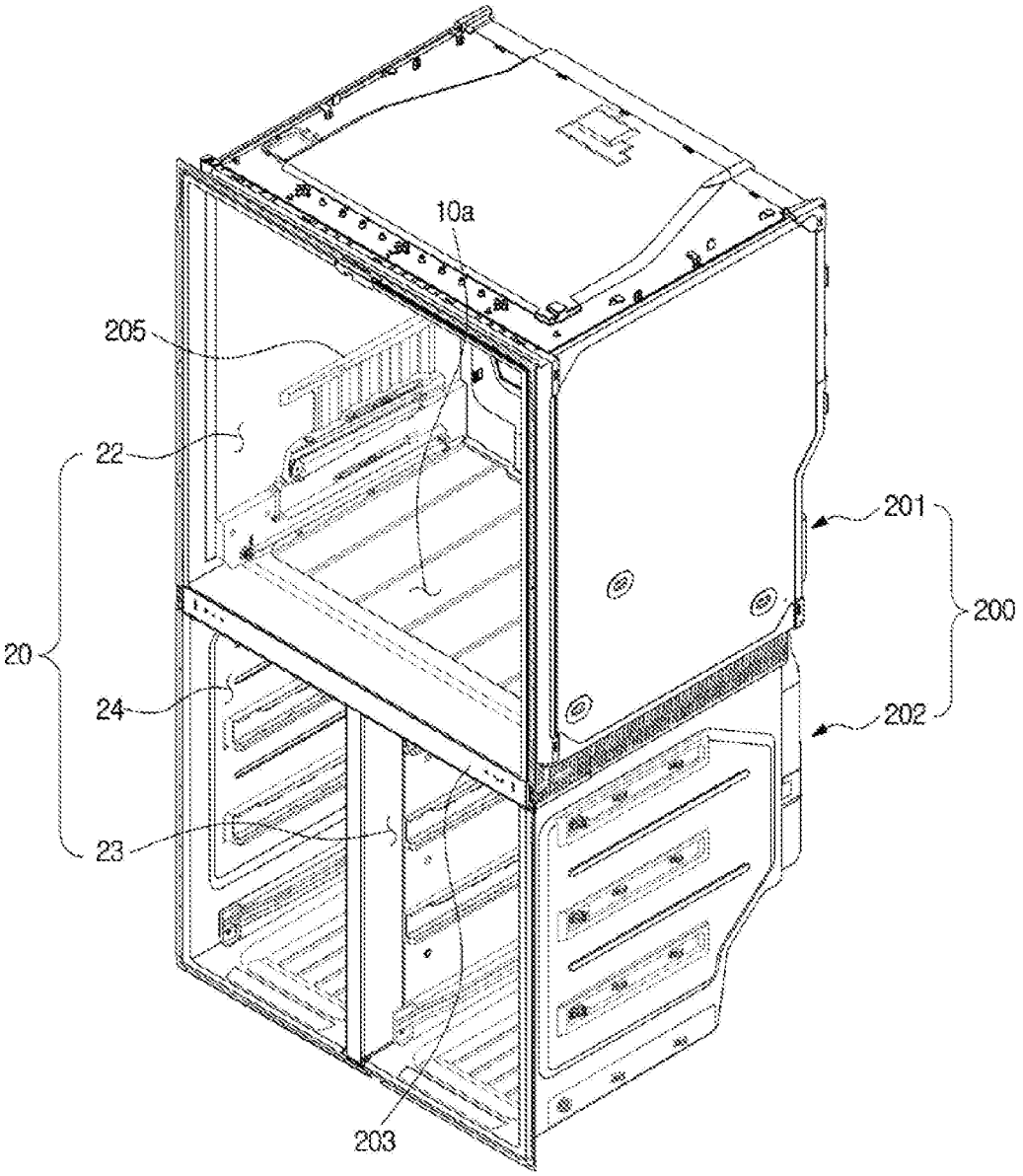
FIG. 3 is a view illustrating inner cases of the refrigerator according to one embodiment of the present disclosure.
Figure 4:
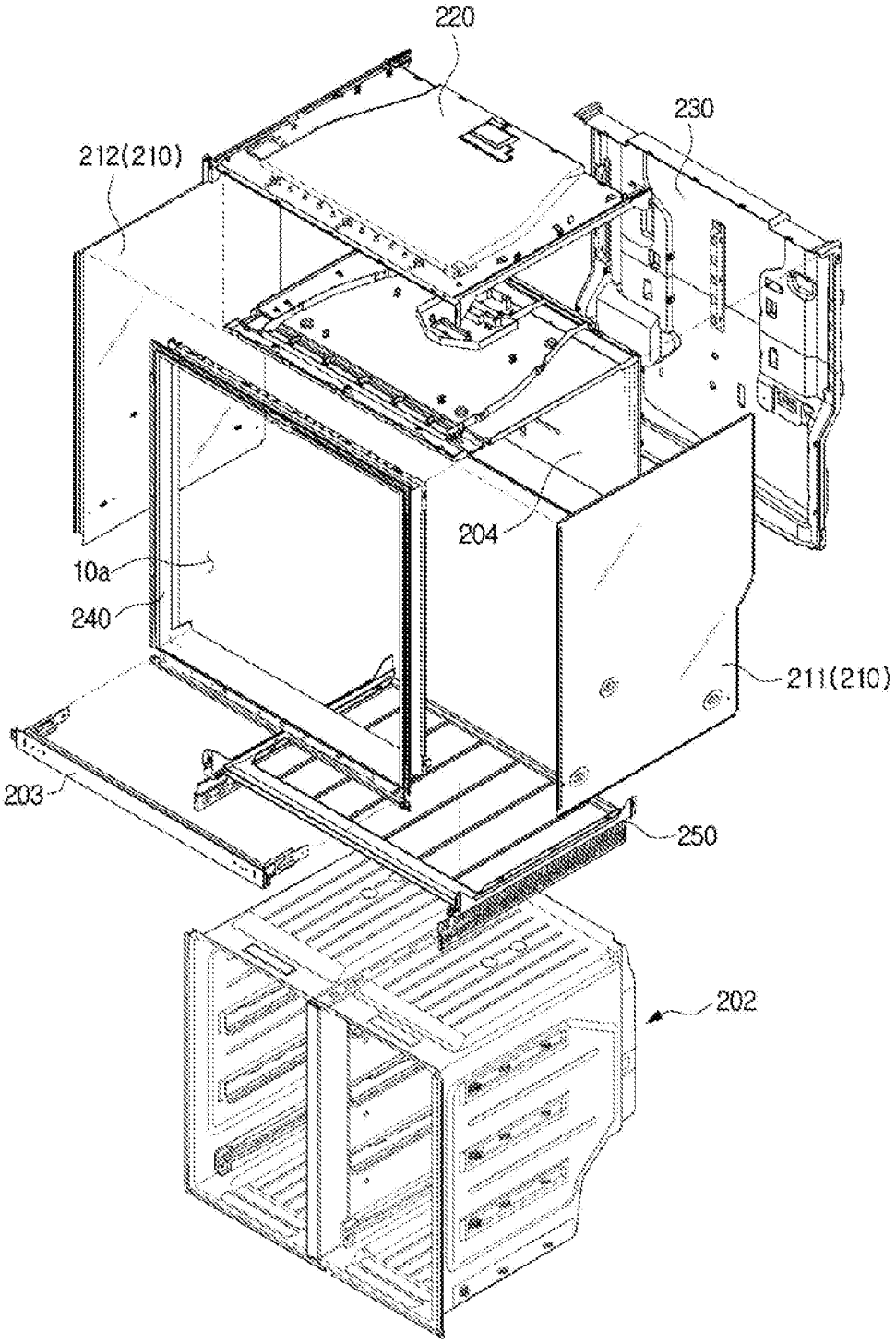
FIG. 4 is an exploded view illustrating the inner cases of the refrigerator illustrated in FIG. 3.

FIG. 3 is a view illustrating inner cases of the refrigerator according to one embodiment of the present disclosure, and FIG. 4 is an exploded view illustrating the inner cases of the refrigerator illustrated in FIG. 3;

Referring to FIGS. 3 and 4, inner cases 200 forming the storage compartment 20 may include a first inner case 201 forming the upper storage compartment 22, and second inner cases 202 forming the lower storage compartments 23 and 24. In addition, the inner cases 200 may be formed by assembling sheets forming surfaces of the storage compartments 20, and using a vacuum forming method, which is a conventional method of forming an inner case.

In the embodiment illustrated in FIGS. 3 and 4, the first inner case 201 includes an assembly type inner case and the second inner case 202 includes an inner case formed by a vacuum forming method, but the first inner case 201 may also include an inner case formed by the vacuum forming method and the second inner case 202 may also include an assembly type inner case, or both the first inner case 201 and the second inner case 202 may include assembly type inner cases. Hereinafter, the inner case 200 is defined as an inner case including an assembly type inner case like the first inner case 201.

The inner case 200 may include an upper sheet 220, a lower sheet 250, a left sheet 212, a right sheet 211, a rear sheet 230, and a front cover 240 forming the storage compartment 20. The front cover 240 may include the main body opening 10*a*, and a front surface reinforcing material 203, to which the door unit 100 and the like may be fixed, may be attached to a front surface of the front cover 240.

An interior material 204 configured to cover at least a part of the upper sheet 220, the lower sheet 250, the left sheet 212, the right sheet 211, and the rear sheet 230 of the inner case 200 may be disposed inside the storage compartment 20. A cold air duct configured to cool the storage compartment 20 may be formed between the interior material 204 and the inner case. The interior material 204 may be formed of various materials such as a metal material and a resin material. In addition, rails 205 provided such that the shelf 25 or the storage container 26 may be installed thereon may be attached to the left sheet 212 and the right sheet 211 of the inner case 200.

The inner case 200 may be formed by individually forming and assembling the upper sheet 220, the lower sheet 250, the left sheet 212, the right sheet 211, the rear sheet 230, and the front cover 240. Specifically, at least two members among the upper sheet 220, the lower sheet 250, the left sheet 212, the right sheet 211, the rear sheet 230, and the front cover 240 may be assembled by an engagement method.

Figure 5:
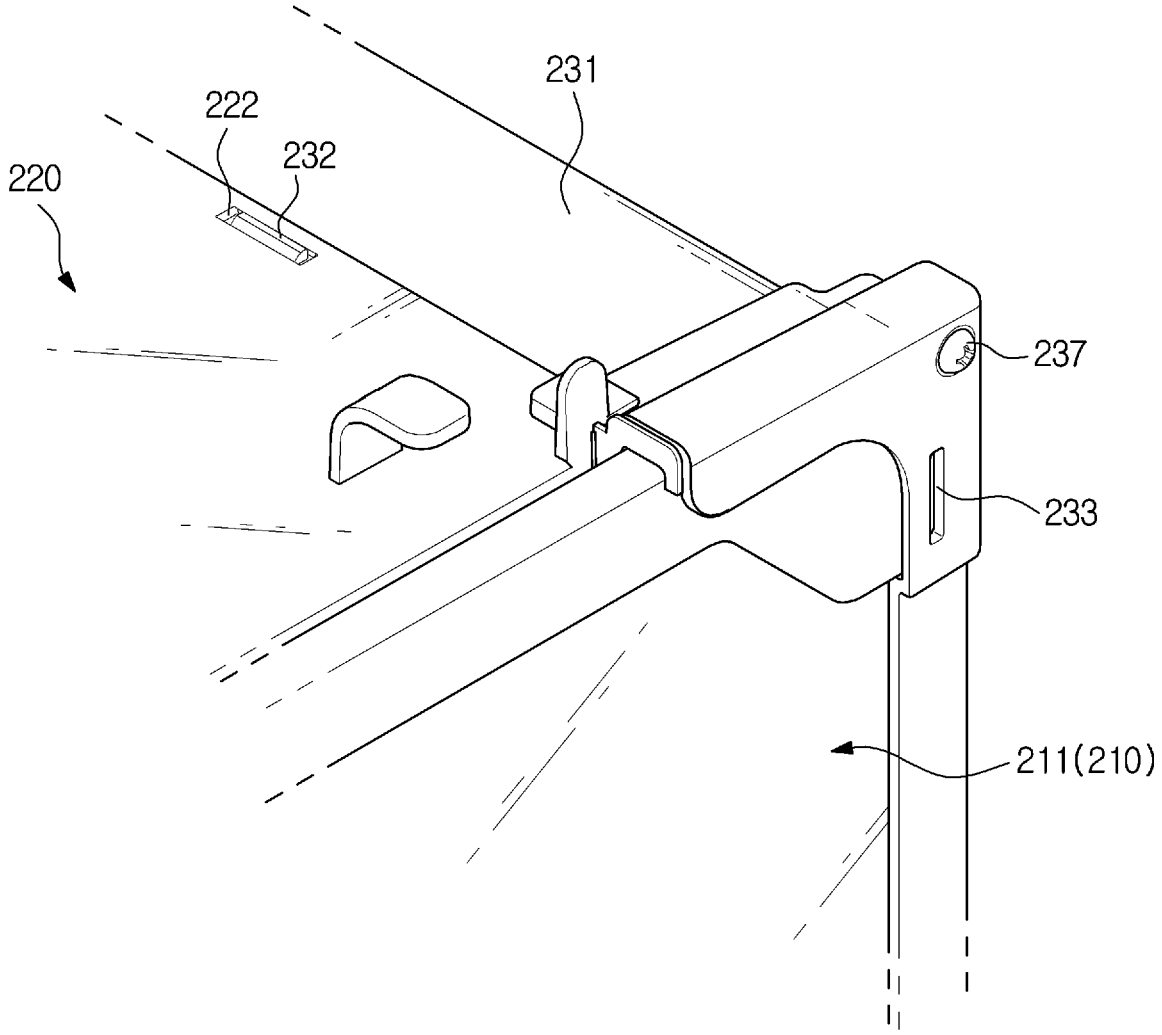
FIG. 5 is an enlarged view illustrating a coupling portion of an upper sheet, a right sheet, and a rear sheet of the inner case of the refrigerator illustrated in FIG. 3.
Figure 6:
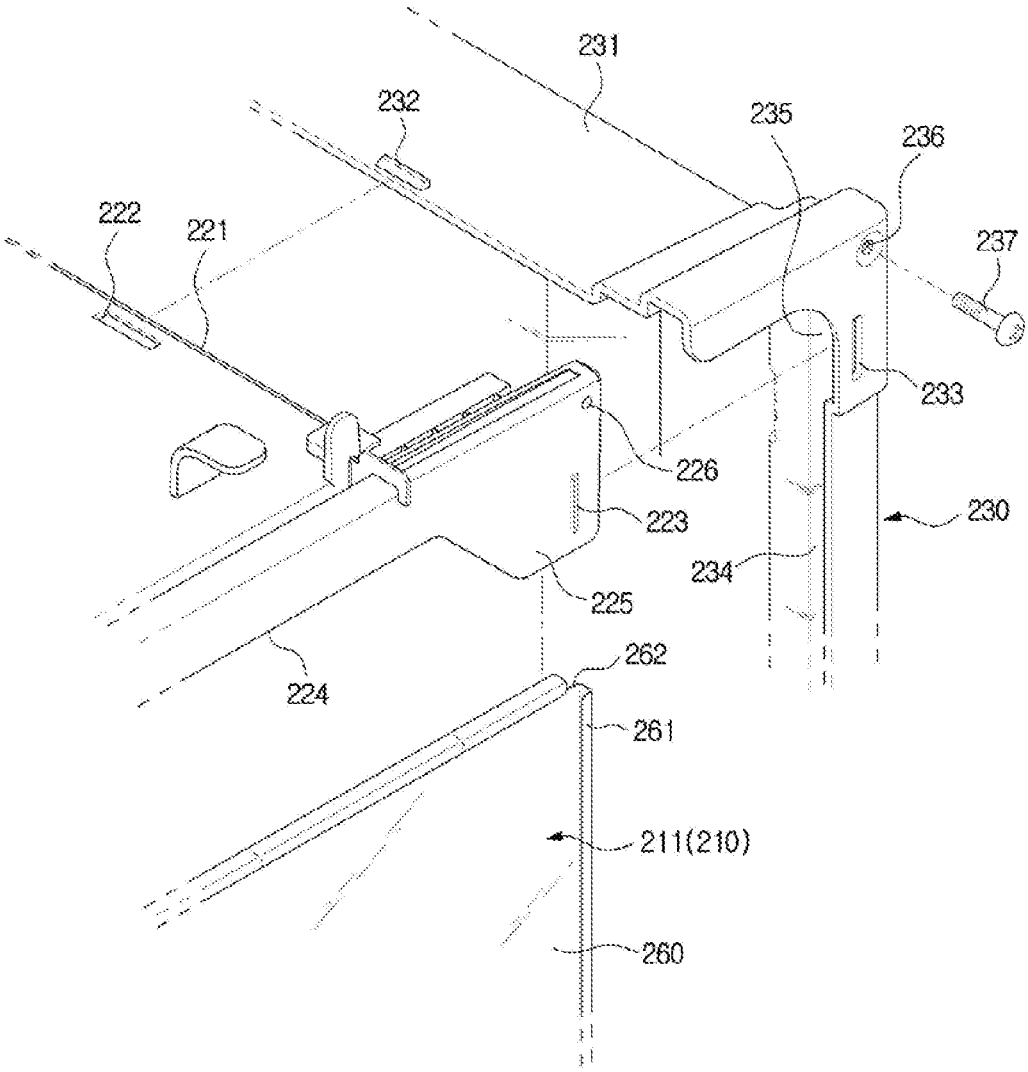
FIG. 6 is an exploded view illustrating the coupling portion of the upper sheet, the right sheet, and the rear sheet of the inner case of the refrigerator illustrated in FIG. 5.
Figure 7:
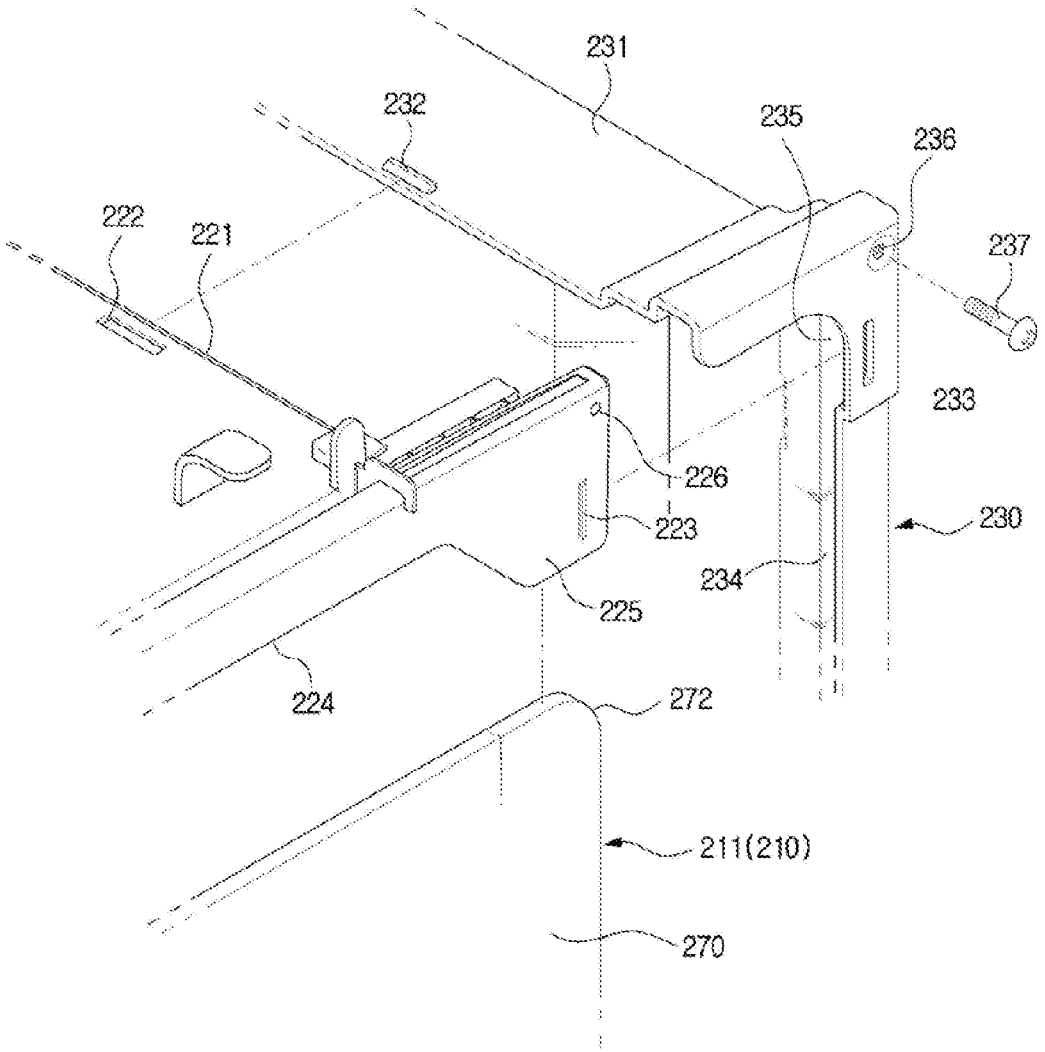
FIG. 7 is an exploded view illustrating a coupling portion of the upper sheet of the inner case of the refrigerator illustrated in FIG. 5, a right sheet having a different thickness from the right sheet illustrated in FIG. 6, and a rear sheet.
Figure 8:
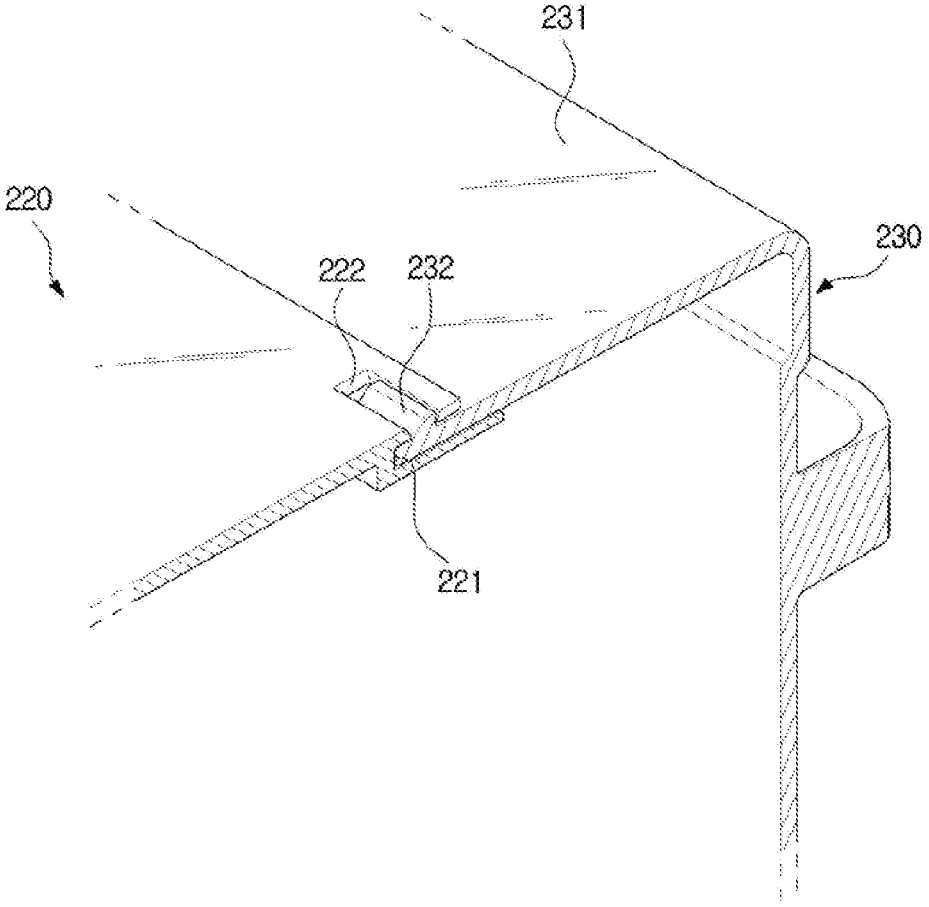
FIG. 8 is a cross-sectional view illustrating the coupling portion of the upper sheet and the rear sheet of the inner case of the refrigerator illustrated in FIG. 5.

FIG. 5 is an enlarged view illustrating a coupling portion of the upper sheet, the right sheet, and the rear sheet of the inner case of the refrigerator illustrated in FIG. 3, FIG. 6 is an exploded view illustrating the coupling portion of the upper sheet, the right sheet, and the rear sheet of the inner case of the refrigerator illustrated in FIG. 5, FIG. 7 is an exploded view illustrating a coupling portion of the upper sheet of the inner case of the refrigerator illustrated in FIG. 5, a right sheet having a different thickness from the right sheet illustrated in FIG. 6, and a rear sheet, and FIG. 8 is a cross-sectional view illustrating the coupling portion of the upper sheet and the rear sheet of the inner case of the refrigerator illustrated in FIG. 5;

Referring to FIGS. 5 to 8, the inner case 200 may be formed to allow the left sheet 212 and the right sheet 211 to be replaceable with different sheets having different thicknesses. Specifically, each of the left sheet 212 and the right sheet 211 of the inner case 200 may include any one sheet among a first sheet and a second sheet having different thicknesses.

Referring to FIG. 6, the right sheet 211 may include a first sheet 260 having a first thickness, and referring to FIG. 7, the right sheet 211 may also include a second sheet 270 having a second thickness greater than the first thickness. Although not illustrated in the drawings, the left sheet 212 may also include the first sheet 260 or the second sheet 270. Hereinafter, each of the right sheet 211 and the left sheet 212 will be commonly referred to and described as a side sheet 210.

At least one sheet among the upper sheet 220, the lower sheet 250, the rear sheet 230, and the front cover 240 may include sheet insertion grooves 224 or 234 into which the side sheet 210 is inserted. The side sheet insertion grooves 224 or 234 may be formed at right and left edges of the at least one sheet among the upper sheet 220, the lower sheet 250, the rear sheet 230, and the front cover 240. The side sheet insertion grooves 224 or 234 may have a width corresponding to the second thickness to allow the first sheet 260 having the first thickness and the second sheet 270 having the second thickness to be inserted into the side sheet insertion grooves 224 or 234.

The first sheet 260 having the first thickness may include edges 261 bent to be engaged with and coupled to the side sheet insertion grooves 224 or 234 having a width corresponding to the second thickness. That is, the edge 261 of the first sheet 260 may be bent to have the second thickness. The edges 261 of the first sheet 260 may be bent two times to be in close contact with three surfaces of the side sheet insertion grooves 224 or 234. Since the edges 261 of the first sheet 260 are engaged and in close contact with the three surfaces of the side sheet insertion grooves 224 or 234, leakage of an insulating material foamed in a space between the inner case 200 and the outer case 11 may be prevented.

Two adjacent members among the upper sheet 220, the lower sheet 250, the rear sheet 230, and the front cover 240 except for the side sheets 210 may also be coupled by an engagement coupling method and fixed by a coupling member 237. Specifically, among a first member and a second member, which are adjacent to each other, among the upper sheet 220, the lower sheet 250, the rear sheet 230, and the front cover 240, the first member may include a first flange 231 configured to extend toward the second member, and the second member may include a first flange insertion groove 221 formed at an edge of the second member located at a side of the first member and configured to allow the first flange 231 of the first member to be inserted into the first flange insertion groove 221.

Referring to FIGS. 5 to 8, the first member may be the rear sheet 230, and the second member may be the upper sheet 220. That is, the rear sheet 230 may include the first flange 231 configured to extend toward the upper sheet, and the upper sheet 220 may include the first flange insertion groove 221 formed at a rear end edge and configured to allow the first flange 231 of the rear sheet 230 to be inserted into the first flange insertion groove 221.

The first member may include a first hook 232 configured to protrude from one surface of the first flange 231 and formed to be spaced a predetermined distance from an end portion of the first flange. In addition, the first member may include a first slot 222 formed in the first flange insertion groove 221 and configured to accommodate the first hook 232 of the rear sheet 230.

Specifically, the first hook 232 may be formed on an upper surface of the first flange 231 of the rear sheet 230, and the first slot 222 may be formed on an upper surface of the first flange insertion groove 221 of the upper sheet 220 in contact with the upper surface of the first flange 231 and at a position corresponding to the first hook 232. Referring to FIG. 8, since the first hook 232 is formed to be spaced the predetermined distance from the end portion of the first flange 231, the first slot 222 is also formed to be spaced the predetermined distance from an innermost side of the upper surface of the first flange insertion groove 221. Through such a shape, leakage of the insulating material filled in the space between the inner case 200 and the outer case 11 through the first slot 222 may be effectively prevented.

Meanwhile, among the adjacent first and second members among the upper sheet 220, the lower sheet 250, the rear sheet 230, and the front cover 240, the first member may include a protrusion 225 formed at an end portion of the side sheet insertion groove 224 of the first member located at a side of the second member and configured to extend toward the second member. The second member may include a protrusion insertion groove 235 formed at an end portion of the side sheet insertion groove 234 of the second member located at a side of the first member and configured to allow the protrusion 225 of the first member to be inserted into the protrusion insertion groove 235.

Referring to FIGS. 5 to 8, the first member may be the upper sheet 220, and the second member may be the rear sheet 230. That is, the upper sheet 220 may include the protrusion 225 configured to extend from an end portion of the side sheet insertion groove 224 of the upper sheet 220 located at a side of the rear sheet 230 toward the rear sheet 230, and the rear sheet 230 may include the protrusion insertion groove 235 formed at an end portion of the side sheet insertion groove 234 of the rear sheet 230 located at the side of the upper sheet 220 and configured to allow the protrusion 225 of the upper sheet 220 to be inserted into the protrusion insertion groove 235.

Since the protrusion 225 of the upper sheet 220 is formed by the side sheet insertion groove 224 being extended, the side sheet 210 is even inserted into the protrusion 225. Accordingly, the protrusion insertion groove 235 formed at an upper end of the side sheet insertion groove 234 of the rear sheet 230 is formed to have a width greater than that of the side sheet insertion groove 234. Specifically, the protrusion insertion groove 235 may have the width corresponding to a sum of the second thickness and a thickness of a sheet forming the upper sheet 220.

A second hook 223 spaced a predetermined distance from an end portion of the protrusion 225 may be formed on one surface of the protrusion 225. In addition, a second slot 233 in which the second hook 223 may be accommodated may be provided on one surface of the protrusion insertion groove 235.

The protrusion 225 and the protrusion insertion groove 235 respectively formed on the adjacent first member and the second member among the upper sheet 220, the lower sheet 250, the rear sheet 230, and the front cover 240 may be fixed by the coupling member 237. Specifically, the protrusion 225 of the first member and the protrusion insertion groove 235 of the second member may respectively include coupling holes 226 and 236, and the protrusion 225 and the protrusion insertion groove 235 may be coupled by a force being applied to the coupling member 237 such as a screw from the outside toward the inside of the first member.

Although not illustrated in the drawings, the rear sheet 230 and the lower sheet 250 may also be coupled through a method similar to the coupling method of the rear sheet 230 and the upper sheet 220 and fixed by a coupling member. In addition, the front cover 240 and the upper sheet, and the front cover 240 and the rear sheet 230 may also be coupled through methods similar to the coupling method of the rear sheet 230 and the upper sheet 220 and fixed by coupling members. As four front corners and four rear corners of the inner case 200 are fixed by coupling members 237, the assembly type inner case 200 may not be inclined in one direction.

The side sheet 210 may include escape portions 262 or 272 such that the coupling members 237 do not pass through the side sheet 210 or do pass around the side sheet 210. The escape portions 262 of the side sheet 210 including the first sheet 260 illustrated in FIG. 6 may be formed at corners of the side sheet 210 while the edges of side sheet 210 are bent. In addition, it is preferable for the side sheet 210 including the second sheet illustrated in FIG. 7 to include the corner rounded with a radius of 2 mm to prevent corner damage. The rounded corner may serve as the escape portions 272 through which the coupling members 237 do not pass through the side sheet 210 or do pass around the side sheet 210.

Figure 9:
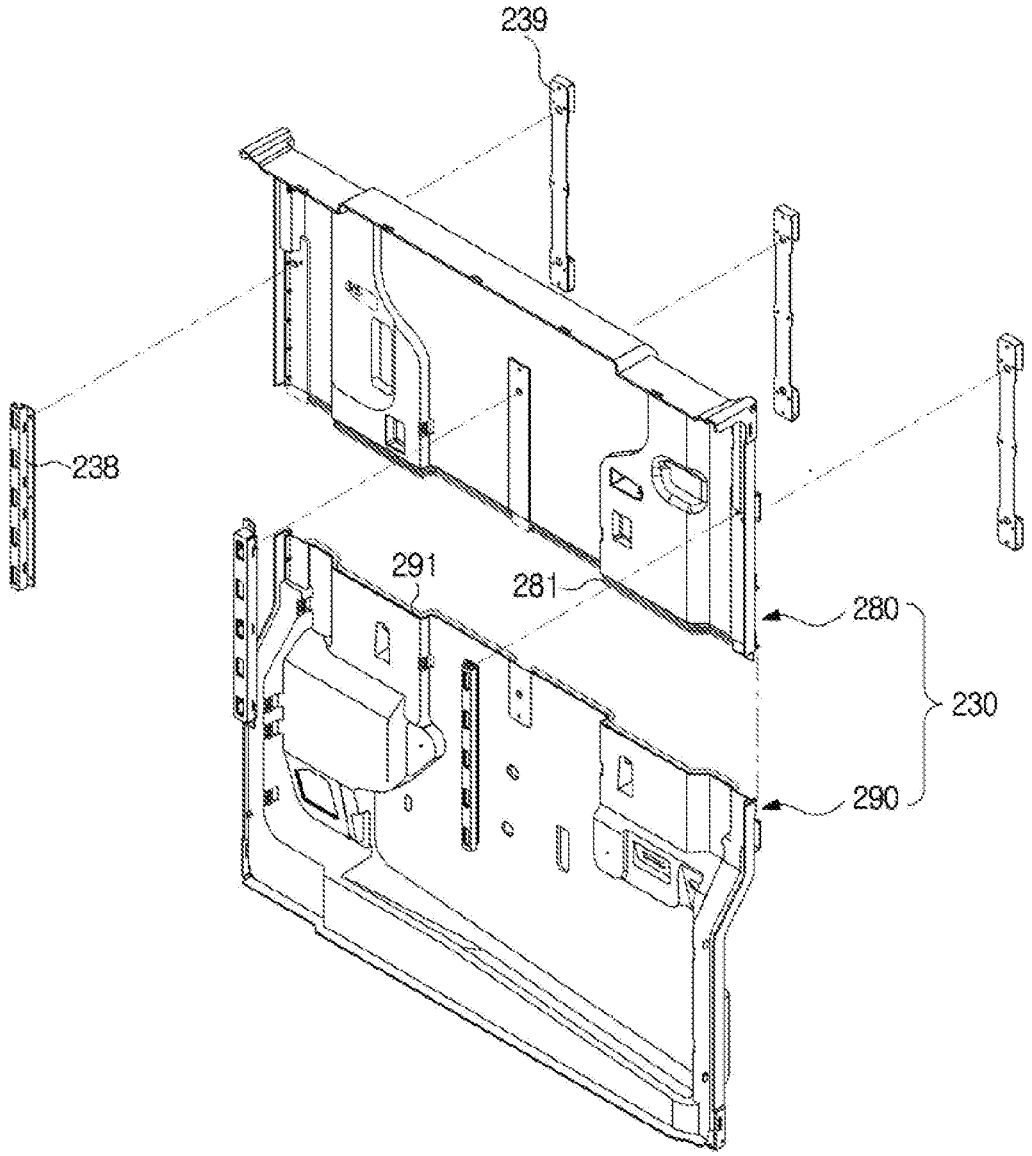
FIG. 9 is an exploded view illustrating the rear sheet of the refrigerator illustrated in FIG. 3.
Figure 10:
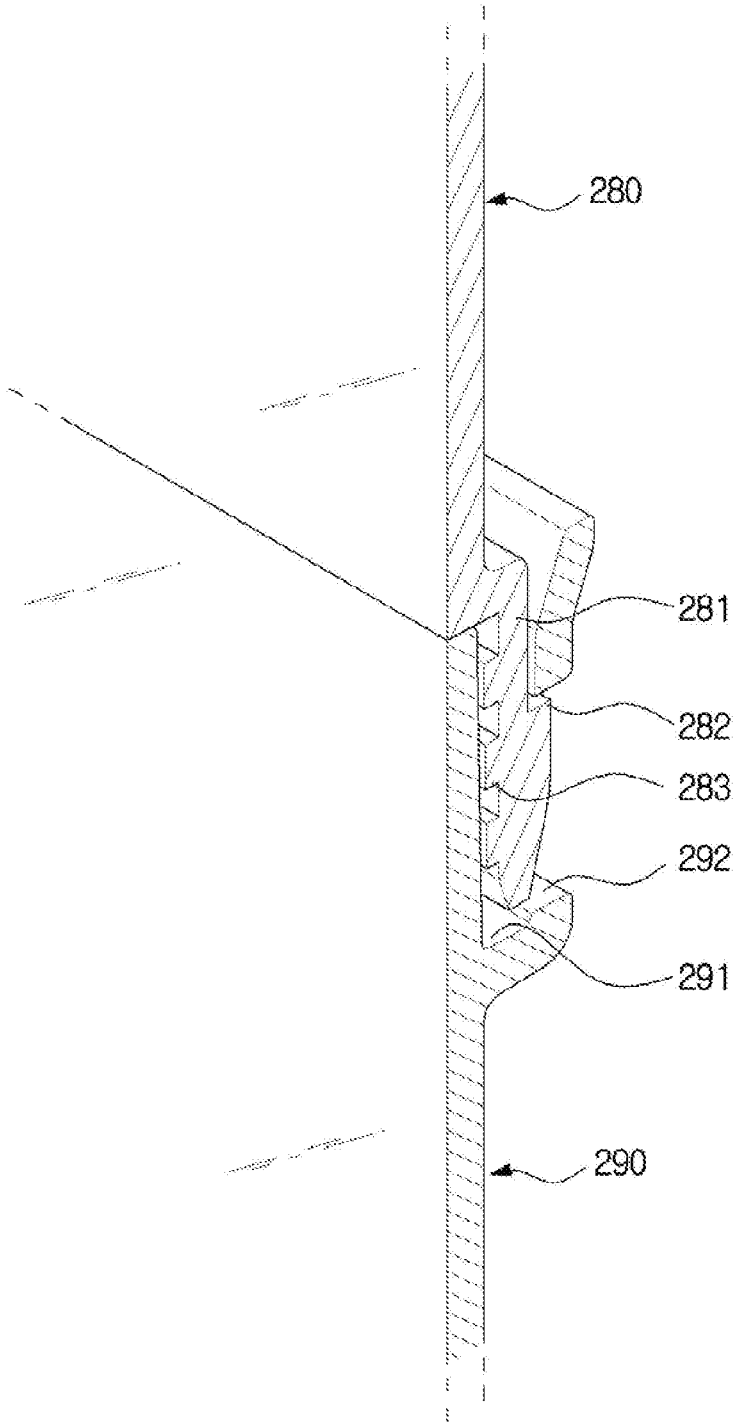
FIG. 10 is a cross-sectional view illustrating a coupling portion of a first rear sheet and a second rear sheet of the rear sheet illustrated in FIG. 9.

FIG. 9 is an exploded view illustrating the rear sheet of the refrigerator illustrated in FIG. 3, and FIG. 10 is a cross-sectional view illustrating a coupling portion of a first rear sheet and a second rear sheet of the rear sheet illustrated in FIG. 9;

Referring to FIGS. 9 and 10, the rear sheet 230 of the inner case 200 of the refrigerator 1 may include a first rear sheet 280 and a second rear sheet 290 disposed vertically. Generally, since the rear sheet 230 of the inner case 200 has a complex shape to perform various functions, the rear sheet 230 is formed of a resin material by injection molding. As a size of refrigerator 1 increases, a size of the rear sheet 230 of the inner case 200 also increases. Accordingly, when a big rear sheet 230 is formed by coupling a plurality of members, production efficiency can be increased.

The first rear sheet 280 may include a second flange 281 formed at a edge of the first rear sheet 280 located at a side of the second rear sheet 290 to assemble the first rear sheet 280 and the second rear sheet 290, and the second rear sheet 290 may include a second flange insertion groove 291 formed at a edge of the second rear sheet 290 located at a side of the first rear sheet 280 to allow the second flange 281 of the first rear sheet 280 to be inserted into the second flange insertion groove 291.

Specifically, since the first rear sheet 280 may be disposed at an upper side of the second rear sheet 290, the first rear sheet 280 may include the second flange 281 provided at a lower end edge of the first rear sheet 280, and the second rear sheet 290 may include the second flange insertion groove 291 provided at an upper end edge of the second rear sheet 290.

Referring to FIG. 10, the first rear sheet 280 may include an uneven portion 283 formed on one surface of the second flange 281 to prevent leakage of the insulating material configured to be foamed in the space between the inner case 200 and the outer case 11. In addition, the first rear sheet 280 may include a third hook 282 formed to protrude from the other surface of the second flange 281. The uneven portion 283 of the second flange 281 may include a plurality of uneven portion to more securely prevent leakage of the insulating material. A third slot 292 in which the third hook 282 may be accommodated may be provided on one surface of the second flange insertion groove 291.

Referring to FIG. 9, the rear sheet 230 of the inner case 200 may include a support member 239 attached to a rear surface of the rear sheet 230 and configured to connect the first rear sheet 280 and the second rear sheet 290 to secure strength and firmly couple the first rear sheet 280 and the second rear sheet 290. In addition, the rear sheet 230 may include a shelf installation member 238 attached to a front surface of the rear sheet 230 and fixed to the support member 239 to allow the shelf 25 and the like to be installed in the storage compartment 20.

The support member 239 and the shelf installation member 238 may be formed of a metal material. Since the support member 239 and the shelf installation member 238 pass through the rear sheet 230 to be coupled, strength of the rear sheet 230 can be increased, and the first rear sheet 280 and the second rear sheet 290 can be firmly coupled. In addition, the rear sheet 230 may firmly support the shelf 25 using the support member 239 when the shelf 25 is installed at the shelf installation member 238 even in the storage compartment 20.

In the inner case 200 of the refrigerator 1 according to the present disclosure, since the upper sheet 220, the lower sheet 250, the left sheet 212, the right sheet 211, the rear sheet 230, and the front cover 240 may be assembled and formed, materials of the members may be easily changed. Particularly, the side sheet 210 may include the first sheet 260 or the second sheet 270 having different thicknesses, and may also include the first sheet 260 or the second sheet 270 having different materials.

In the refrigerator according to the present disclosure, since a material of the inner case 200 may be widely selected, the refrigerator 1 which satisfies a consumer's sensibility and preference can be provided, and a value due to visual quality thereof can be increased. For example, the first sheet 260 having the first thickness illustrated in FIG. 6 may include a metal material. In addition, the second sheet 270 having the second thickness illustrated in FIG. 7 may include a ceramic material.

Since the first sheet 260 formed of the metal material has a thermal conductivity higher than that of the first sheet 260 formed of a resin material, an inner surface of the storage compartment 20 may be cooled within a shorter period time such that the storage compartment 20 may have a uniform temperature distribution. Since the second sheet 270 formed of a ceramic material may prevent the smell of food stored in the storage compartment 20 from permeating the inner case 200, cleanness in the storage compartment 20 may be improved.

Figure 11:
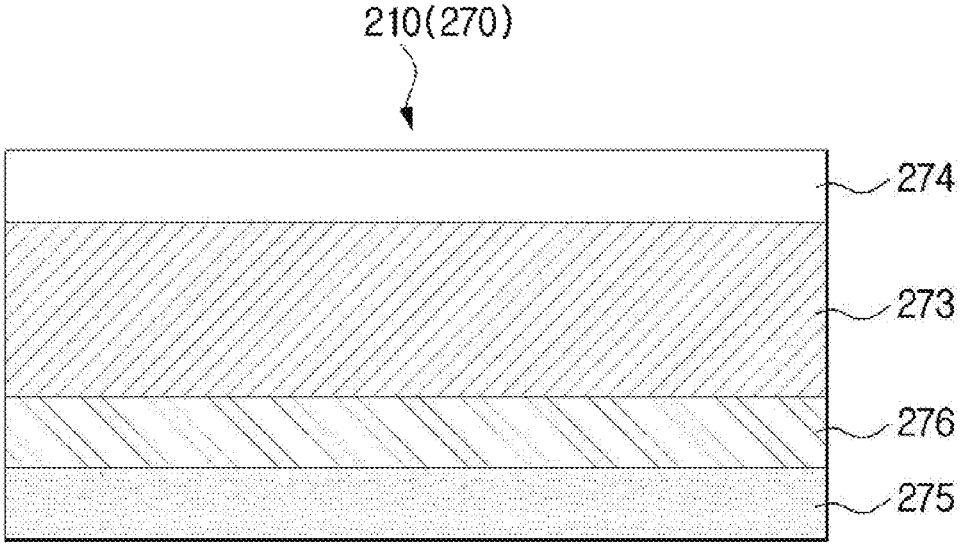
FIG. 11 is a cross-sectional view illustrating a sheet forming a side sheet of the inner case of the refrigerator according to one embodiment of the present disclosure.
Figure 12:
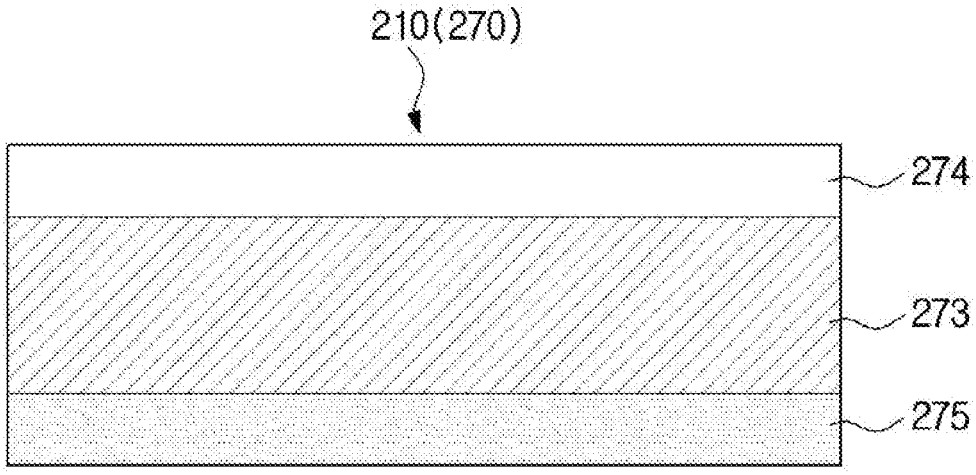
FIG. 12 is a cross-sectional view illustrating a sheet forming a side sheet of an inner case of a refrigerator according to another embodiment of the present disclosure.
Figure 13:
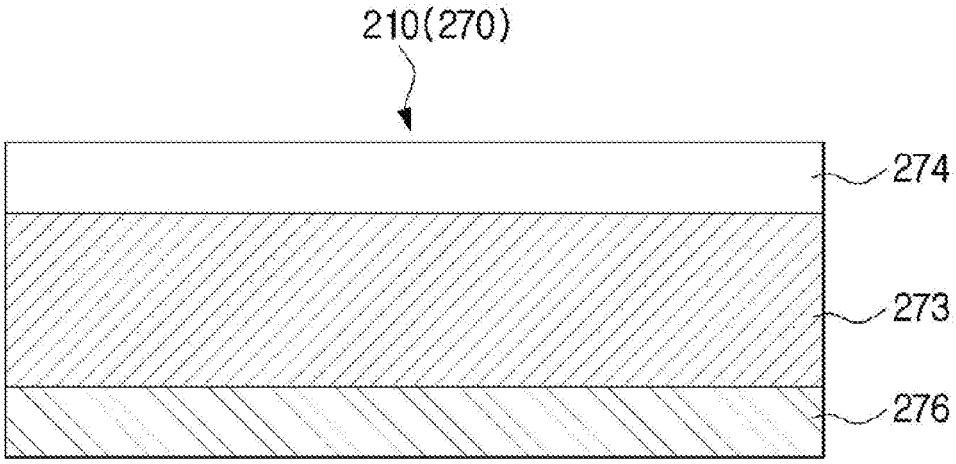
FIG. 13 is a cross-sectional view illustrating a sheet forming a side sheet of an inner case of a refrigerator according to still another embodiment of the present disclosure.

FIG. 11 is a cross-sectional view illustrating a sheet forming the side sheet of the inner case of the refrigerator according to one embodiment of the present disclosure, FIG. 12 is a cross-sectional view illustrating a sheet forming a side sheet of an inner case of a refrigerator according to another embodiment of the present disclosure, and FIG. 13 is a cross-sectional view illustrating a sheet forming a side sheet of an inner case of a refrigerator according to still another embodiment of the present disclosure;

Referring to FIGS. 11 to 13, the second sheet 270 of the side sheet 210 may include a body layer 273 including a ceramic material, a coated layer 274 formed on the body layer 273 located at a side of the storage compartment 20, and a reinforcing layer formed on the body layer 273 located at a side of the outer case 11.

Specifically, the reinforcing layer may include at least one layer of a first reinforcing layer 275 including a metal material and a second reinforcing layer including a fiber material. When the second sheet 270 includes both the first reinforcing layer 275 and the second reinforcing layer 276, it is preferable for the first reinforcing layer 275 including the metal material to be disposed at the outermost side of the second sheet 270.

Figure 14:
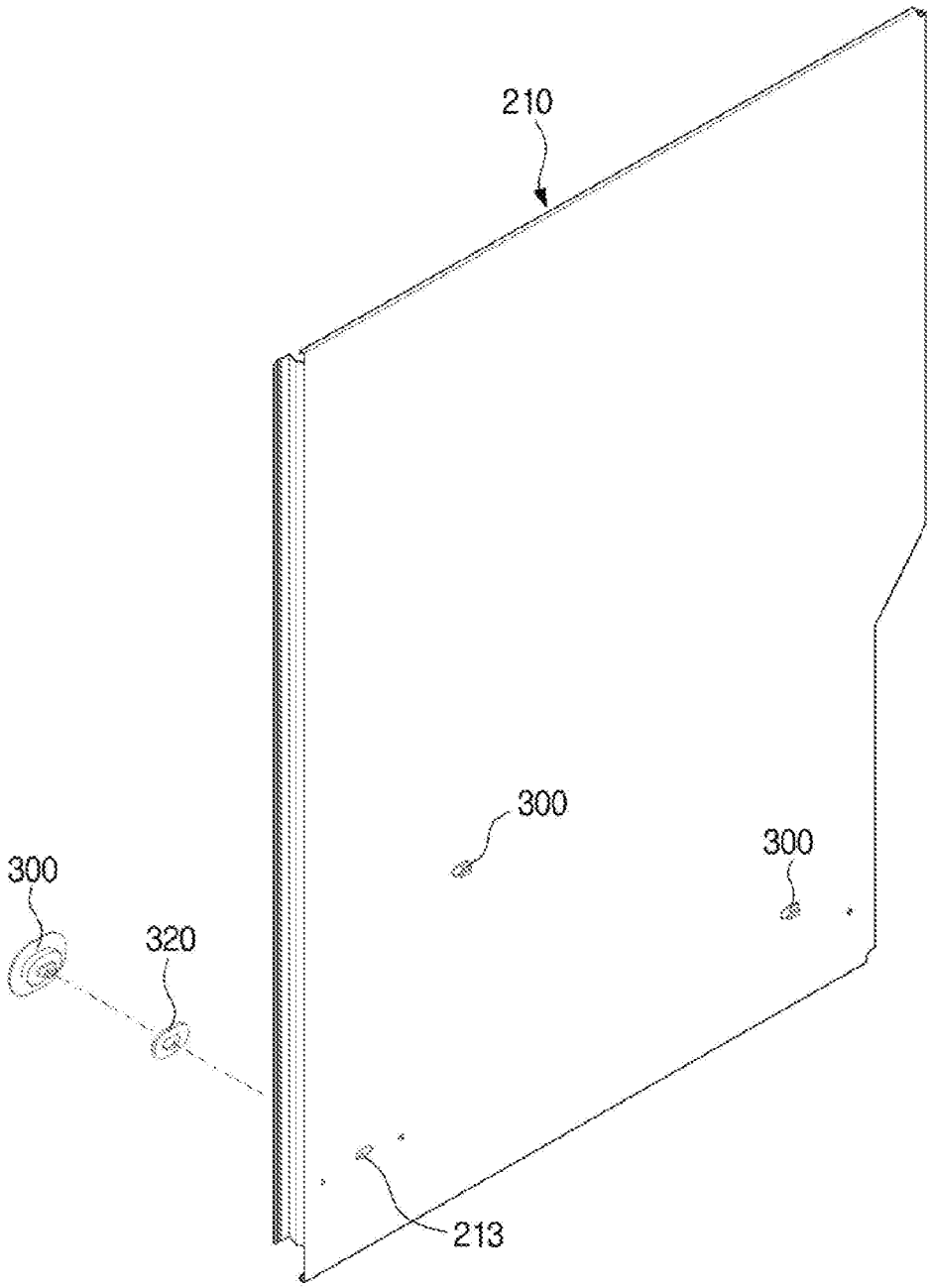
FIG. 14 is a view illustrating a storage container installation member separated from the side sheet of the refrigerator according to one embodiment of the present disclosure.
Figure 15:
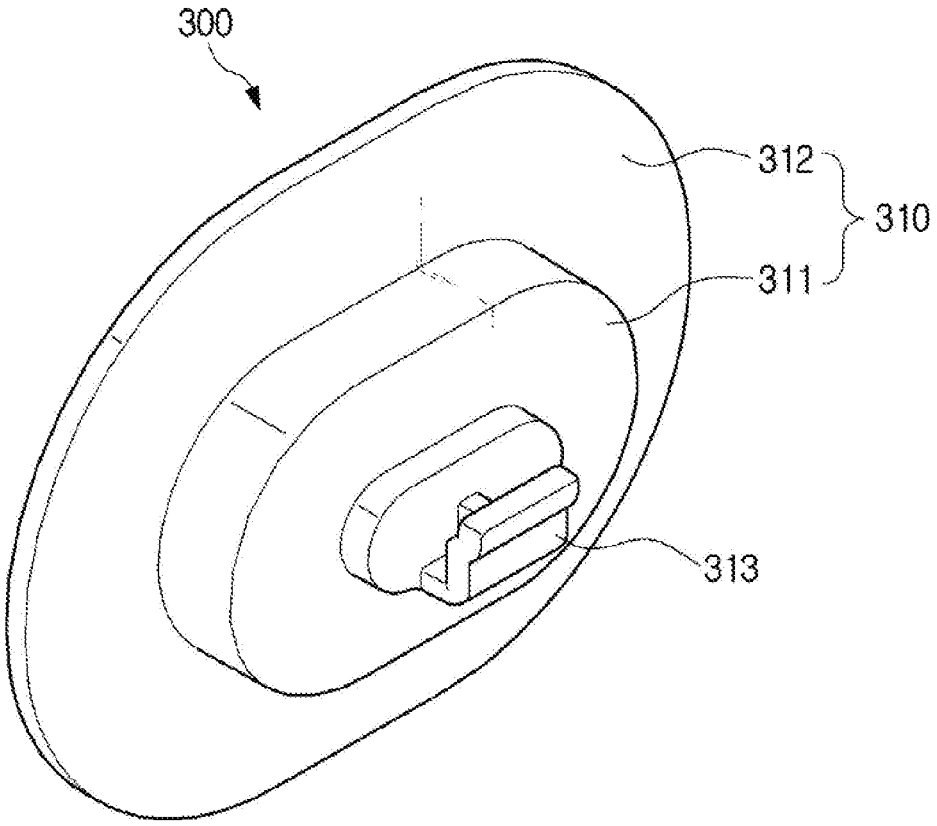
FIG. 15 is a perspective view illustrating the storage container installation member illustrated in FIG. 14.
Figure 16:
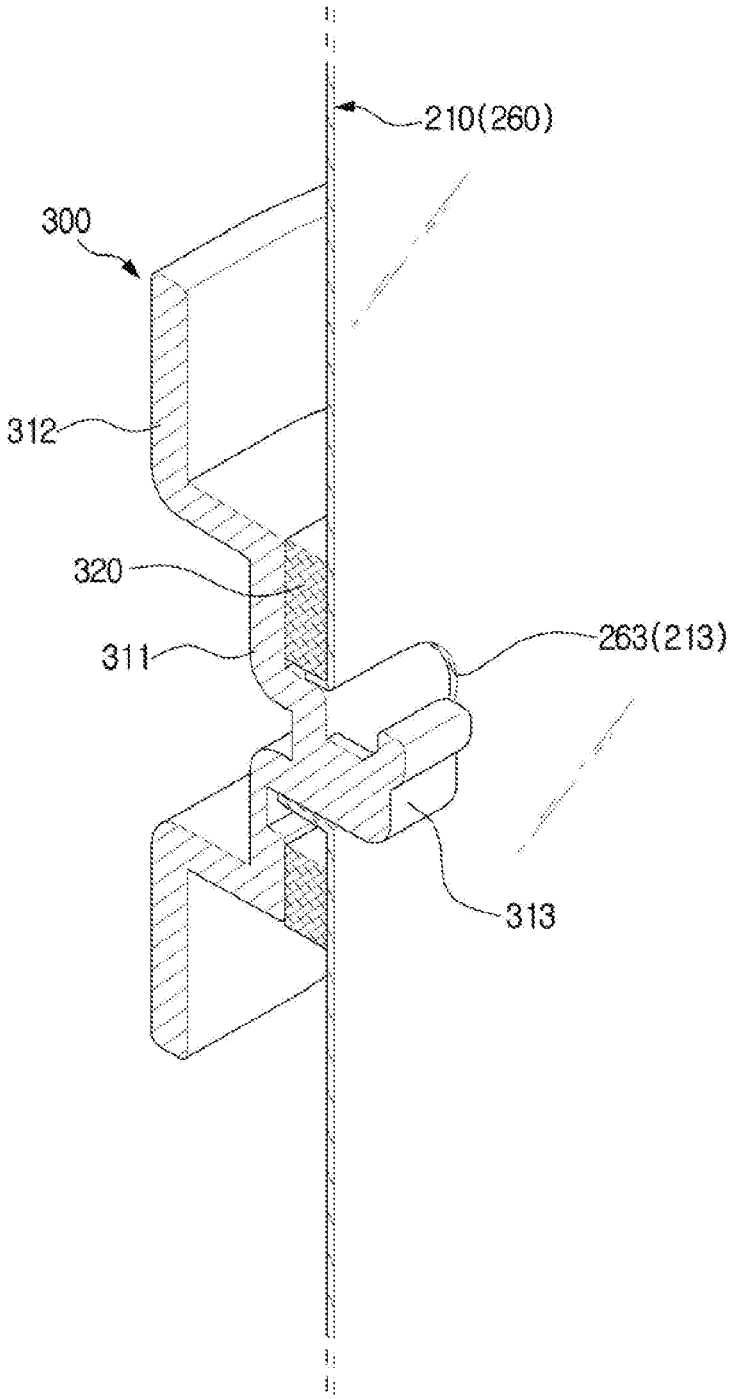
FIG. 16 is a cross-sectional view illustrating a state in which the storage container installation member illustrated in FIG. 14 is attached to the side sheet of the inner case.
Figure 17:
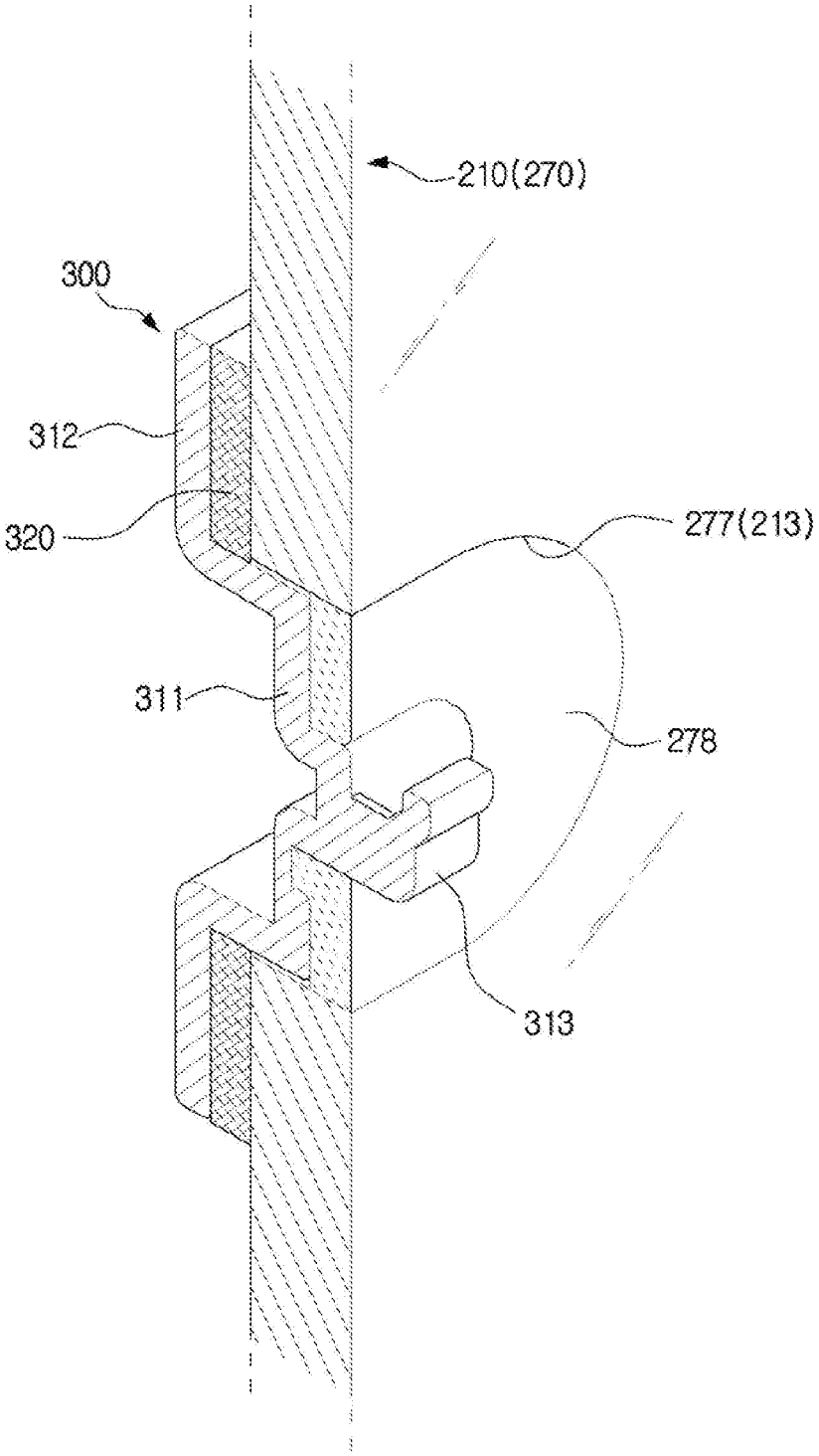
FIG. 17 is a cross-sectional view illustrating a state in which the storage container installation member illustrated in FIG. 14 is attached to a side sheet having a different thickness from the side sheet of the inner case illustrated in FIG. 16.

FIG. 14 is a view illustrating a storage container installation member separated from the side sheet of the refrigerator according to one embodiment of the present disclosure, FIG. 15 is a perspective view illustrating the storage container installation member illustrated in FIG. 14, FIG. 16 is a cross-sectional view illustrating a state in which the storage container installation member illustrated in FIG. 14 is attached to the side sheet of the inner case, and FIG. 17 is a cross-sectional view illustrating a state in which the storage container installation member illustrated in FIG. 14 is attached to a side sheet having a different thickness from the side sheet of the inner case illustrated in FIG. 16.

Referring to FIGS. 3 and 14 to 17, the refrigerator 1 may include storage container installation members 300 to allow the storage container 26 to be installed in the storage compartment 20, and an installation member installation hole 213, in which the storage container installation members 300 may be installed, may be provided in the left sheet 212 and the right sheet 211 of the inner case 200 forming the storage compartment 20.

Specifically, the storage container installation member 300 may include a rail hook 313 on which the rail 205 and the like, through which the storage container 26 may be installed, may be installed, and a side sheet support 310 supported by the side sheet 210. The rail hook 313 may be disposed to pass through the installation member installation hole 213 formed in the side sheet 210 to protrude into the storage compartment 20, and the side sheet support 310 may be supported by an outer surface of the side sheet 210.

The storage container installation member 300 may be attached to the side sheet 210 using an adhesive 320 such as an adhesive tape. That is, the adhesive 320 may be interposed between the side sheet support 310 of the storage container installation member 300 and the side sheet 210.

The storage container installation member 300 may include a plurality of side sheet supports to be supported by two or more sheets having different thicknesses. Specifically, the storage container installation member 300 may include a first support 311 supported by the first sheet 260 having the first thickness and a second support 312 supported by the second sheet 270 having the second thickness greater than the first thickness. The first support 311 may be formed to protrude from the second support 312 to a height corresponding to the second thickness.

Referring to FIG. 16, the first sheet 260 having the first thickness, which is a relatively thin thickness, may support the first support 311 of the storage container installation member 300. The first installation member installation hole 263 of the first sheet 260 may be formed to allow only the rail hook 313 of the storage container installation member 300 to pass through the first installation member installation hole 263, and to allow the first support 311 configured to extend from an outer circumferential surface of the rail hook 313 to be supported by a periphery of the first installation member installation hole 263.

Referring to FIG. 17, the second sheet 270 having the second thickness greater than the first thickness may support the second support 312 of the storage container installation member 300. The second installation member installation hole 277 of the second sheet 270 may be formed to allow the rail hook 313 and the first support 311 of the storage container installation member 300 to pass through the second installation member installation hole 277, and to allow the second support 312 configured to extend from an outer circumferential surface of the first support 311 to be supported by a periphery of the second installation member installation hole 277.

When holes such as the second installation member installation hole 277 are formed in the second sheet 270 including the ceramic material, it is preferable for a gap between the holes to be 30 mm or more. In addition, it is preferable for the holes to be spaced 30 mm or more from an edge of the second sheet 270.

Since the second installation member installation hole 277 is wider than the first installation member installation hole 263 by an area of the first support 311, a finishing material 278 for filling a groove formed by an inner surface of the second sheet 270 and the first support 311 of the storage container installation member 300 may be disposed in the second installation member installation hole 277 of the second sheet 270.

Since the storage container installation member 300 includes the first support 311 supported by the first sheet 260 having the first thickness and the second support 312 supported by the second sheet 270 having the second thickness greater than the first thickness, the storage container installation member 300 can be commonly used even when the side sheets 210 of the inner case 200 use sheets having different thicknesses.

Figure 18:
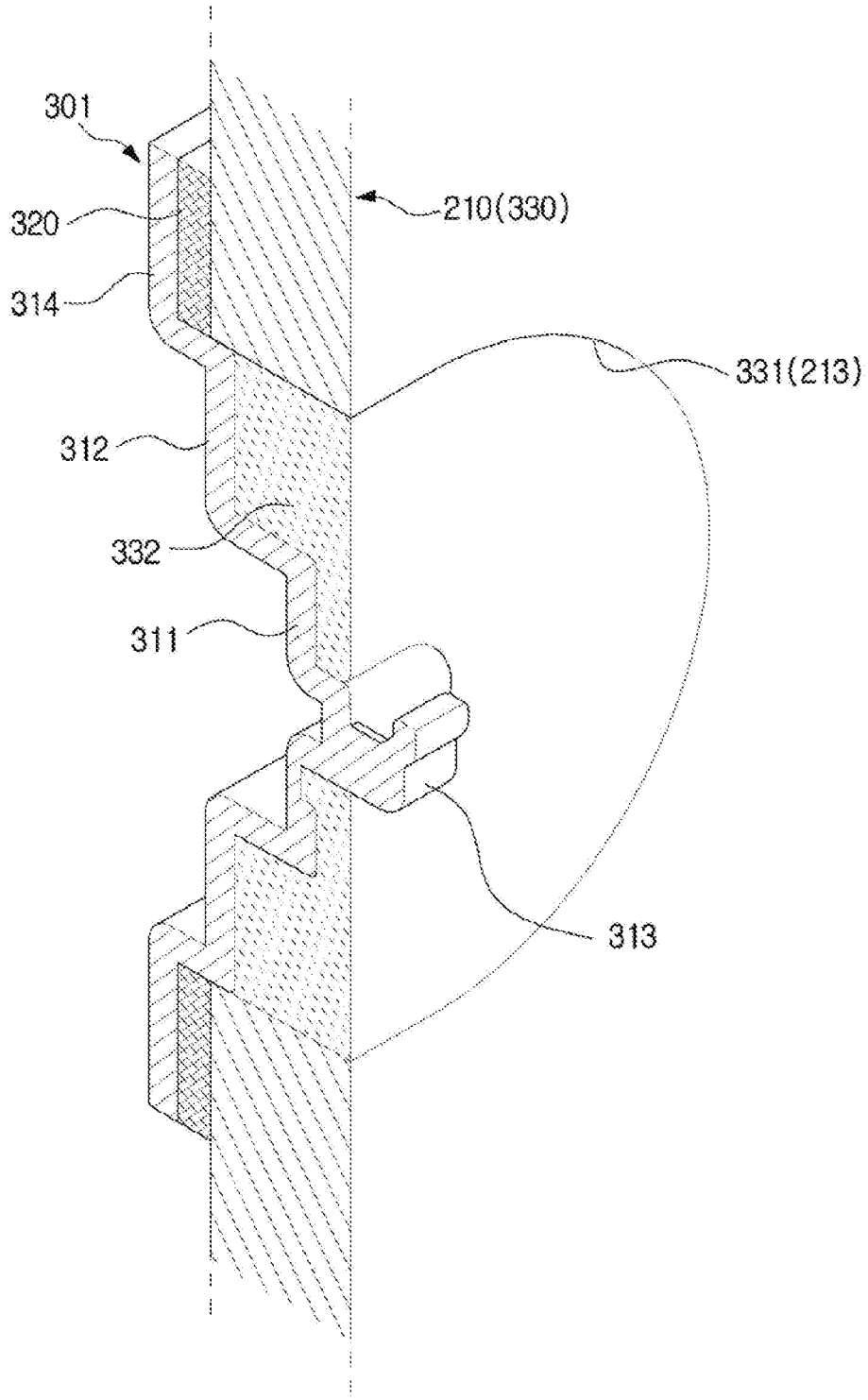
FIG. 18 is a view illustrating a state in which a storage container installation member according to another embodiment of the present disclosure is attached to a side sheet having a different thickness from the side sheets of the inner case illustrated in FIG. 16 and FIG. 17.

FIG. 18 is a view illustrating a state in which a storage container installation member according to another embodiment of the present disclosure is attached to a side sheet having a different thickness from the side sheets of the inner case illustrated in FIG. 16 and FIG. 17.

Referring to FIG. 18, a storage container installation member 301 may include a first support 311, a second support 312, and a third support 314 to be supportable by three or more sheets having different thicknesses. Specifically, the storage container installation member 301 may include the third support 314 recessed from the second support 312 by a difference between a third thickness of a third sheet illustrated in FIG. 18 and a second thickness of a second sheet 270 illustrated in FIG. 17. That is, the second support 312 may be formed to protrude from the third support 314 to a height corresponding to the difference between the third thickness and the second thickness.

A third installation member installation hole 331 formed in a third sheet 330 may be formed to allow a rail hook 313, the first support 311, and the second support 312 of a storage container installation member 301 to pass through the third installation member installation hole 331, and to allow the third support 314 configured to extend from an outer surface of the second support 312 to be supported by a periphery of third installation member installation hole 331.

Since the third installation member installation hole 331 is wider than a second installation member installation hole 277 by an area of the second support 312, a finishing material 332 for filling a groove formed by an inner surface of the third sheet 330 and the first and second supports 311 and 312 of the storage container installation member 301 may be formed in the third installation member installation hole 331 of the third sheet 330. The finishing material 332 may be formed to correspond to shapes of the first support 311 and the second support 312 of the storage container installation member 301.

Although not illustrated in the drawing, at least adjacent two sheets among an upper sheet 220, a lower sheet 250, and a rear sheet 230 forming an inner case 200 may be integrally formed. That is, the upper sheet 220 and the rear sheet 230 may be integrally formed, the lower sheet 250 and the rear sheet 230 may be integrally formed, or all of the upper sheet 220, the rear sheet 230, and the lower sheet 250 may be integrally formed. The at least two integrally formed sheets may include side sheet insertion grooves configured to allow side sheets to be inserted into the side sheet insertion grooves.

As is apparent from the above description, since a refrigerator can include an inner case formed by several sheets being assembled, a refrigerator including an inner case having various materials can be formed by forming sheets having various materials.

Since an inner case is formed to allow a sheet located at one side of the inner case to be replaceable, the sheet can be replaced with another sheet having a different material or thickness from that of the sheet without an additional mold being manufactured, and thus a refrigerator including the inner case having various materials and designs can be provided.

The scope of the present disclosure is not limited to the above described specific embodiments. Various different embodiments which may be changed and modified by those skilled in the art without departing from the gist of the technical spirit of the present disclosure described in the appended claims are included within the scope of the present disclosure.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

an inner case configured to form a storage compartment;

an outer case coupled to an outer side of the inner case and configured to form an exterior; and an insulating material interposed between the inner case and the outer case, wherein:

the inner case includes an upper sheet, a lower sheet, a left sheet, a right sheet, a rear sheet, and a front cover;

each of the left sheet and the right sheet is provided to be replaceable with a sheet having a different thickness;

each of the left sheet and the right sheet includes a first sheet having a first thickness and a second sheet having a second thickness greater than the first thickness and the second sheet provided to be replaceable with the first sheet; and the first sheet includes an edge bent to correspond to the second thickness.

2. The refrigerator of claim 1, wherein at least one among the upper sheet, the lower sheet, the rear sheet, and the front cover includes side sheet insertion grooves formed at left and right edges thereof to allow the left sheet and the right sheet to be inserted into the side sheet insertion grooves.

3. The refrigerator of claim 1, wherein:

among a first member and a second member, which are adjacent to each other, among the upper sheet, the lower sheet, the rear sheet, and the front cover, the first member includes a flange configured to extend toward the second member; and the second member includes a flange insertion groove formed at an edge of the second member located at a side of the first member and configured to allow the flange of the first member to be inserted into the flange insertion groove.

4. The refrigerator of claim 3, wherein:

the first member includes a hook configured to protrude from one surface of the flange and formed to be spaced a predetermined distance from an end portion of the flange; and the second member includes a slot formed in the flange insertion groove and configured to accommodate the hook.

5. The refrigerator of claim 1, wherein:

among a first member and a second member, which are adjacent to each other, among the upper sheet, the lower sheet, the rear sheet, and the front cover, the first member includes a protrusion formed at an end portion of a side sheet insertion groove of the first member located at a side of the second member and configured to extend toward the second member; and the second member includes a protrusion insertion groove formed at an end portion of a side sheet insertion groove of the second member located at a side of the first member and configured to allow the protrusion of the first member to be inserted into the protrusion insertion groove.

6. The refrigerator of claim 5, wherein the protrusion of the first member and the protrusion insertion groove of the second member are coupled by a coupling member.

7. The refrigerator of claim 6, wherein the left sheet and the right sheet include escape portions formed at corners thereof such that the coupling member does not pass through the left sheet and the right sheet.

8. The refrigerator of claim 1, wherein:

the rear sheet includes a first rear sheet and a second rear sheet disposed vertically;

the first rear sheet includes a flange formed at an edge of the first rear sheet located at a side of the second rear sheet; and the second rear sheet includes a flange insertion groove formed at an edge of the second rear sheet located at a side of the first rear sheet to allow the flange of the first rear sheet to be inserted into the flange insertion groove.

9. The refrigerator of claim 8, wherein the first rear sheet includes an uneven portion formed at one surface of the flange to prevent leakage of the insulating material.

10. The refrigerator of claim 8, wherein the rear sheet includes a support member attached to a rear surface of the rear sheet and configured to connect the first rear sheet and the second rear sheet.

11. The refrigerator of claim 10, wherein the rear sheet includes a shelf installation member attached to a front surface of the rear sheet and fixed to the support member to allow a shelf to be installed in the storage compartment.

12. The refrigerator of claim 1, wherein:

the rear sheet includes a resin material;

the first sheet includes a metal material; and the second sheet includes a ceramic material.

13. The refrigerator of claim 12, wherein the second sheet includes a body layer having the ceramic material, a coated layer formed on the body layer located at a side of the storage compartment, and a reinforcing layer formed on the body layer located at a side of the outer case.

14. The refrigerator of claim 13, wherein the reinforcing layer includes at least one layer of a first reinforcing layer having a metal material and a second reinforcing layer having a fiber material.

15. A refrigerator comprising:

an inner case configured to form a storage compartment;

an outer case coupled to an outer side of the inner case and configured to form an exterior; and an insulating material interposed between the inner case and the outer case, wherein:

the inner case includes an upper sheet, a lower sheet, a left sheet, a right sheet, a rear sheet, and a front cover;

each of the left sheet and the right sheet includes a first sheet having a first thickness and a second sheet having a second thickness greater than the first thickness;

the first sheet includes an edge bent to correspond to the second thickness; and at least one among the upper sheet, the lower sheet, the rear sheet, and the front cover includes a side sheet insertion groove formed therein to have a width corresponding to the second thickness.

16. The refrigerator of claim 15, further comprising storage container installation members configured to allow a storage container to be installed in the storage compartment, wherein installation member installation holes are provided in the left sheet and the right sheet to allow the storage container installation member to be installed on the left sheet and the right sheet.

17. The refrigerator of claim 16, wherein:

each of the storage container installation members includes a first support provided to correspond to the first sheet and a second support provided to correspond to the second sheet; and the first support is formed to protrude from the second support to a height corresponding to the second thickness.

* * * * *